US006435309B1

(12) United States Patent
Hultqvist

(10) Patent No.: US 6,435,309 B1
(45) Date of Patent: Aug. 20, 2002

(54) LIFTING CARRIAGE

(75) Inventor: Joachim Hultqvist, Åkersberga (SE)

(73) Assignee: Pronomic AB, Sollentuna (SE)

( * ) Notice: Subject to any disclaimer, the term of this patent is extended or adjusted under 35 U.S.C. 154(b) by 0 days.

(21) Appl. No.: 09/486,682

(22) PCT Filed: Sep. 1, 1998

(86) PCT No.: PCT/SE98/01556

§ 371 (c)(1),
(2), (4) Date: May 12, 2000

(87) PCT Pub. No.: WO99/11556

PCT Pub. Date: Mar. 11, 1999

(30) Foreign Application Priority Data

Sep. 1, 1997 (SE) ..... 9703146

(51) Int. Cl.[7] ..... B66F 9/06; B66F 9/08
(52) U.S. Cl. ..... 187/244; 187/222; 187/240
(58) Field of Search ..... 187/233, 240, 187/242, 243, 244, 267, 222, 232; 5/87.1

(56) References Cited

U.S. PATENT DOCUMENTS 4,593,883 A 6/1986 Nelson ..... 254/7 B
5,051,056 A 9/1991 Gibbons et al. ..... 411/678

FOREIGN PATENT DOCUMENTS

| | | |
|---|---|---|
| EP | 0 399 836 | 11/1990 |
| GB | 2 263 096 | 7/1993 |
| WO | PCT 94/15568 | 7/1994 |
| WO | PCT 96/26886 | 9/1996 |

*Primary Examiner*—Dean J. Kramer
*Assistant Examiner*—Thuy V. Tran
(74) *Attorney, Agent, or Firm*—Swidler Berlin Shereff Friedman, LLP

(57) ABSTRACT

The invention relates to a lifting carriage comprising a frame member (2), with a set of wheels (1) provided on the frame member and arranged to enable the movement of the lifting carriage on a base, a carrying member (13), arranged on the frame member (2) and extending upwardly therefrom in a direction away from said base, and a lifting member (14), arranged to receive an object to be lifted and displaceably provided on the carrying member (13). Furthermore, the frame member comprises two sidepieces (3, 4) connected to each other. The sidepieces (3, 4) are connected to each other by at least a first beam member (5) on which the carrying member (13) is arranged and advantageously also by a second beam member (6) connected to and arranged behind the carrying member (13).

15 Claims, 4 Drawing Sheets

13A
13
21
20
19
2
6
10
9
22
15
4
3
5
8
7
18
1
14
1

LIFTING CARRIAGE

TECHNICAL FIELD OF THE INVENTION AND PRIOR ART

The present invention relates to a lifting carriage comprising a frame member, with a set of wheels provided on the frame member and arranged to enable the movement of the lifting carriage on a base, a carrying member, arranged on the frame member and extending upwardly therefrom in a direction away from said base, and a lifting member, arranged to receive an object to be lifted and displaceably provided on the carrying member, wherein the frame member comprises two side pieces connected to each other.

Such lifting carriages are previously known. According to a common concept of construction, the frame member comprises two cross-beams which connect the sidepieces and are arranged substantially in a common vertical plane which extends transversely to the normal moving direction of the lifting carriage. Therewith, the carrying member is fixed in front of the cross-beams to a side surface of these. Usually, the sidepieces comprise at their end portions the wheels by which the carriage may be driven on a floor or another base. However, known lifting carriages have the disadvantage that the length of the frame member in the moving direction tends to be so long that the flexibility and the possibilities to control the lifting carriage are reduced. It is important, when constructing such lifting carriages, that the side beams extend rearwardly from the carrying member by a given shortest length for in a sufficient safe way preventing the lifting carriage from overturning rearwardly. By reason of this safety aspect, the cross-beams located behind the carrying member will reduce the accessible space for the feet of the person which handle the lifting carriage and is to walk and push the lifting carriage in front of him at the same time, which as we know is a common working moment by such lifting carriages. That is due to the fact, that the part of the lifting carriage or the handle said person is to grip by the operation of the lifting carriage must not be positioned at a too long distance behind the carrying member, since such a construction also would lead to instability and a risk of overturning.

SUMMARY OF THE INVENTION

The object of the present invention is to provide a lifting carriage with a compact construction which make it possible to handle the lifting carriage in a flexible and safe way.

This object is obtained by the lifting carriage initially mentioned, which is characterised in that the side pieces are connected to each other by at least a first beam member on which the carrying member is arranged. By providing or putting the carrying member on the connecting beam member in this way, it is possible to avoid that essential portions of the beam member will extend rearwardly or forwardly from the carrying member and interfere with the area which is available behind and in front of the beam member, respectively. Consequently, a compact construction of the lifting carriage is enabled.

According to an embodiment of the invention, the sidepieces are also connected to each other by a second beam member which is connected to and arranged beside the carrying member in the longitudinal direction of the lifting carriage. Thereby, the second beam member is advantageously arranged at a distance from the first beam member seen in a direction perpendicular to the normal moving direction of the lifting carriage. In such a way, it is possible to arrange the second beam member as far above the first beam member and the base, that it does not interfere with the feet space for the person handling the lifting carriage. Advantageously, the second beam member is displaced rearwardly in relation to the first beam member seen in the normal moving direction of the lifting carriage.

According to another embodiment of the invention, the side pieces and said beam members are arranged in such a way that they form a space delimited in three directions, which is shaped to enable the receiving of the lifting member.

According to another embodiment of the invention, the displacement of the lifting member is provided by a driving motor arranged under the first beam member. In such a way, the location of the drive motor will not require any space which may be used, in a better way, by the lifting member or a person handling the lifting carriage. Furthermore, a screw member may be arranged to be rotated by means of the driving motor and via a nut member connected to the lifting member to transform the rotation of the screw member to a translational movement of the lifting member. Advantageously, the screw member may extend through the first beam member.

According to another embodiment of the invention, the carrying member is shaped as an elongated bar-like element. Thereby, the screw member may advantageously extend in said bar-like element. Such an elongated element may be manufactured in extruded aluminium, which guarantee a light and strength construction of the carrying member.

According to another embodiment of the invention, the sidepieces extend, at least partly, in the normal moving direction of the lifting carriage and furthermore these may extend essentially in parallel to each other.

According another embodiment of the invention, at least one of the first and second beam members is manufactured in extruded aluminium.

BRIEF DESCRIPTION OF THE DRAWINGS

The present invention is now to be explained more closely by means of an embodiment and with reference to the attached drawings, in which.

DETAILED DESCRIPTION OF ONE EMBODIMENT OF THE INVENTION

Figure 1:
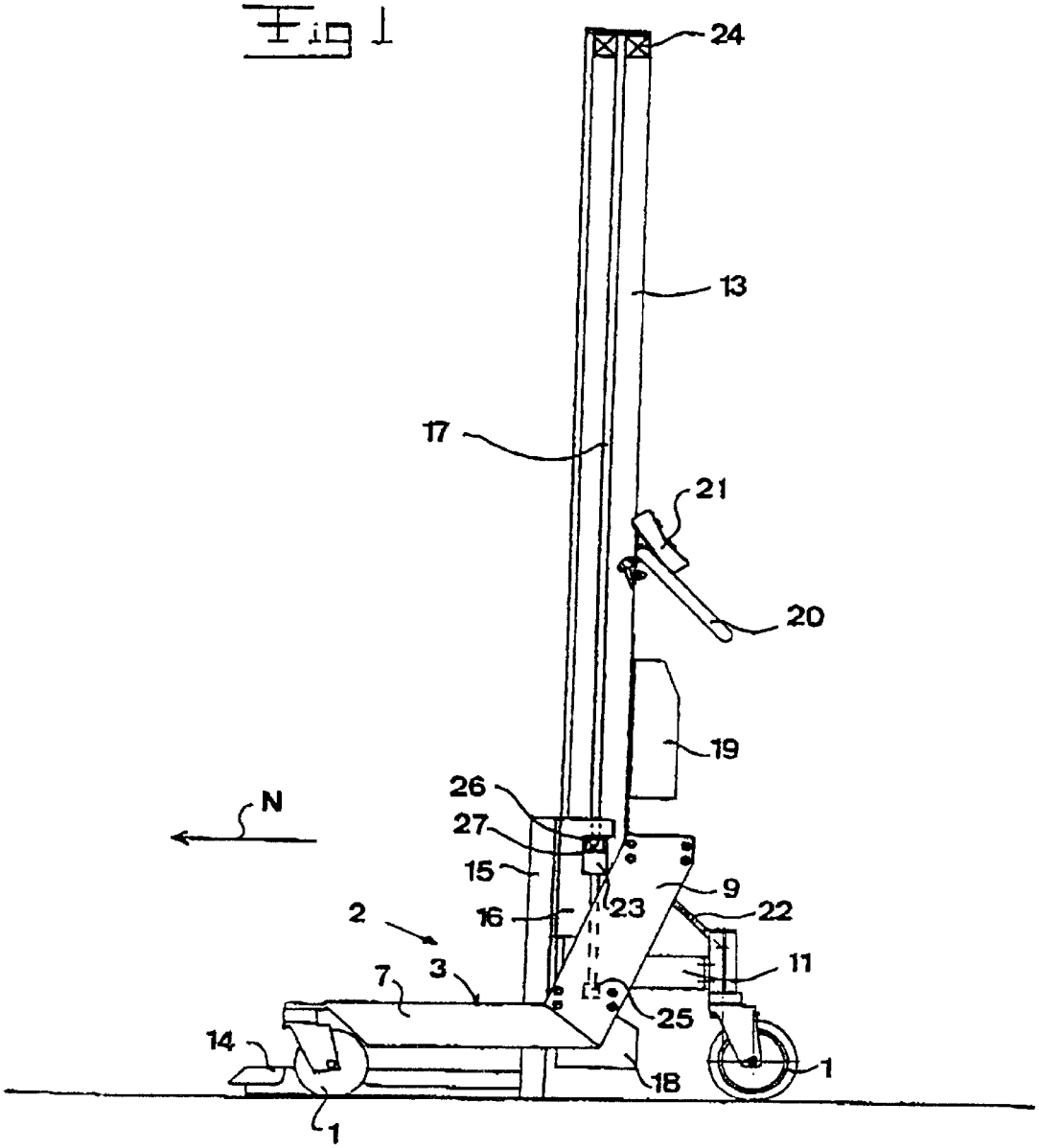
FIG. 1 shows a partly sectional view from the side of a lifting device according to one embodiment of the invention.
Figure 2:
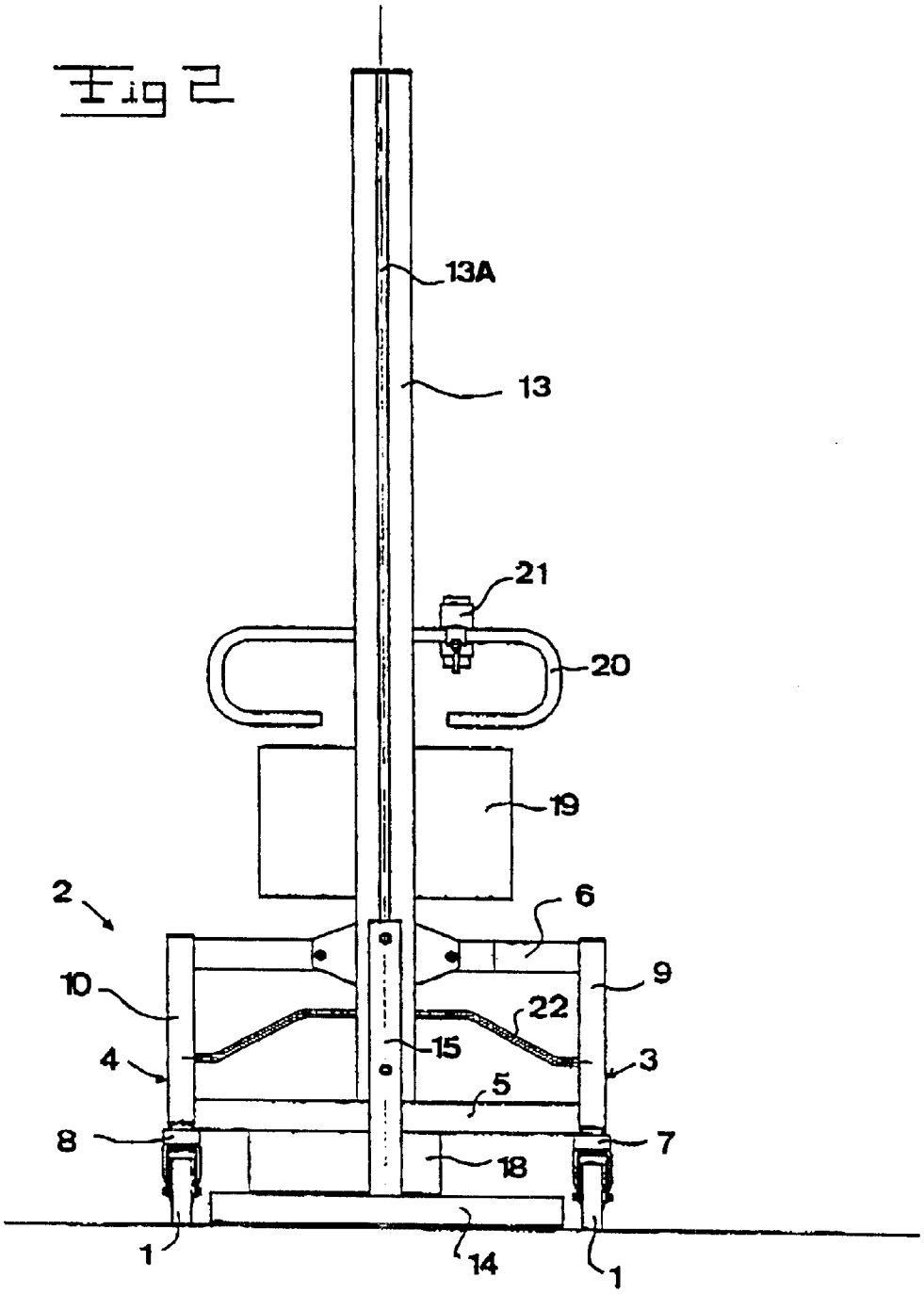
FIG. 2 shows a front view of the lifting device of FIG. 1.
Figure 3:
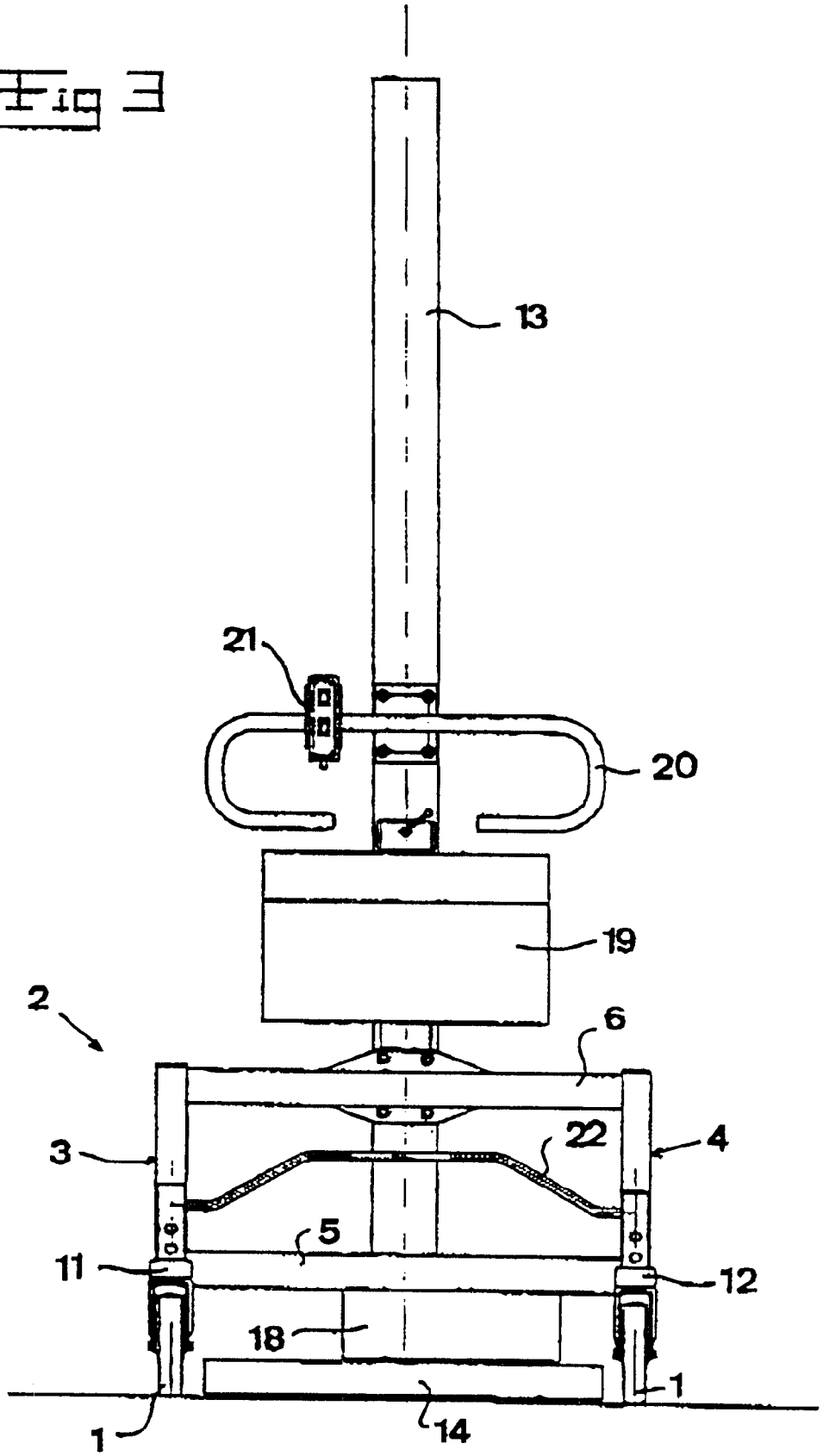
FIG. 3 shows a view from behind of the lifting device in FIG. 1.
Figure 4:
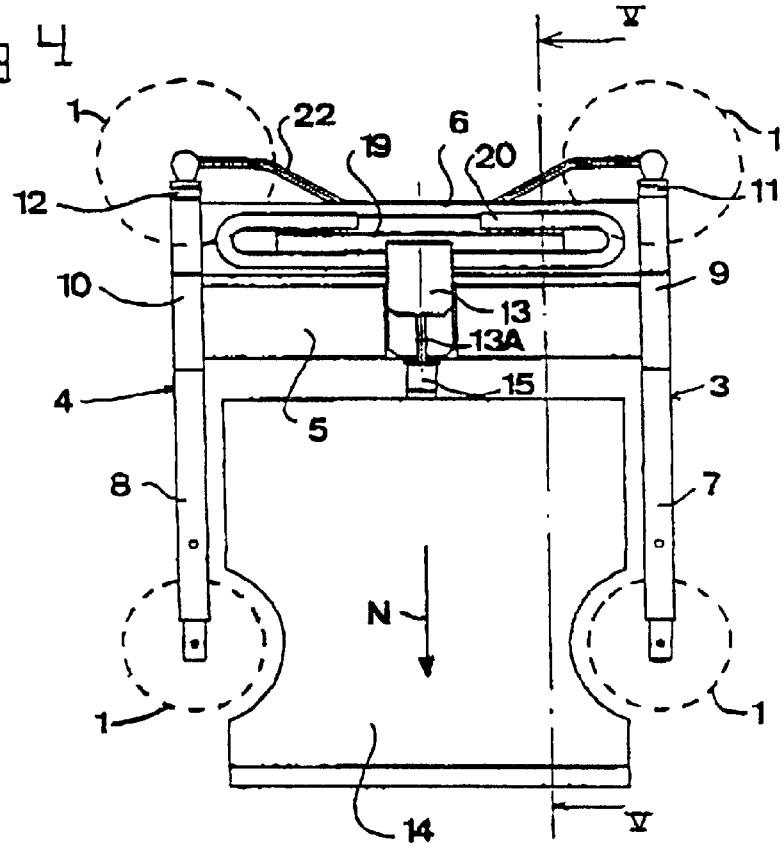
FIG. 4 shows a view from above of the lifting device in FIG. 1.
Figure 5:
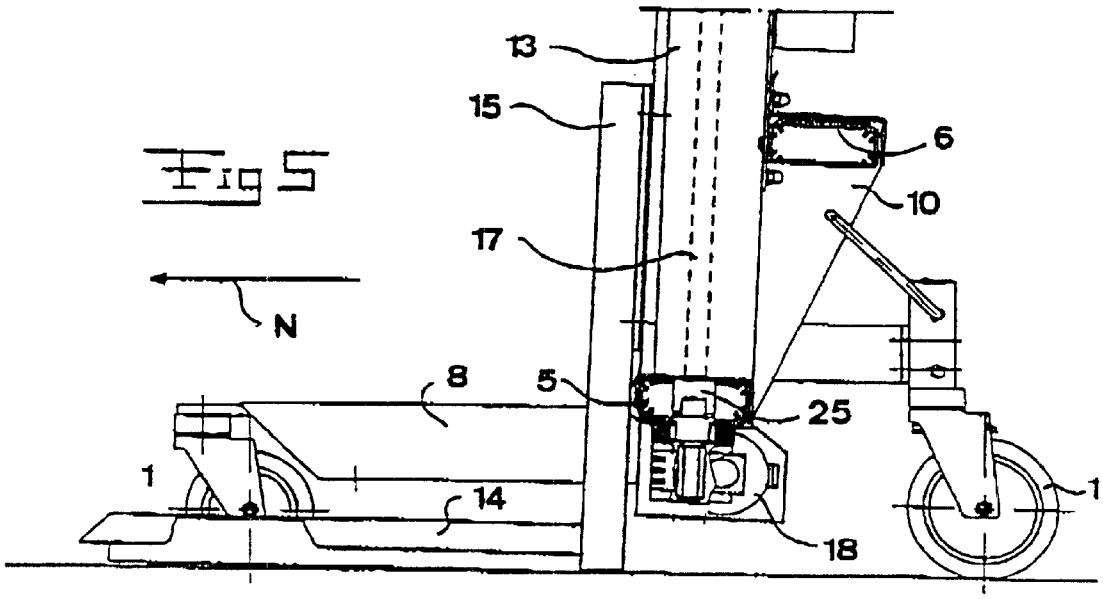
FIG. 5 shows a section along the line V—V in FIG. 4.

With reference to FIGS. 1 to 5, a lifting carriage according to the present invention is shown. The lifting carriage comprises four wheels 1 to facilitate the movement of the lifting carriage on a floor or any other base. The wheels 1 are arranged in fork-like wheel suspension members, of which at least one of the front and rear pairs is rotatable, see FIG. 4, around a vertical axis on a frame member 2, which comprises two side pieces 3 and 4, extending essentially parallel to each other and pointing, seen from above, in the normal moving direction N of the lifting carriage. It is to be noted that within the scope of the invention, it is possible to allow the side pieces 3 and 4 to diverge somewhat, in the moving direction N. Each side piece 3, 4 may be constructed of a simple sheet material or, in connection with lifting carriages for heavy loads, comprise a beam construction of a more complicated cross-section profile, for example an essentially rectangular one, which may be formed by an extruded profile of aluminium. The side pieces 3 and 4 are connected to each other by a first, lower beam 5 and a second, upper beam 6, which consequently is positioned at a distance from and above the first beam 5. Preferably, the beams 5 and 6 comprise an extruded profile of aluminium, see FIG. 5, which guarantees a high strength of the beams 5, 6, and at the same time the weight of the lift carriage may be kept at a suitable level.

Each side piece 3, 4 consist of a first, lower part 7 and 8, respectively, extending mainly in the moving direction N of the lifting carriage and essentially in parallel to said base, and a second portion 9 and 10, respectively, extending obliquely upwardly from the lower portion 7, 8 and sloping in relation to the moving direction N. Thereby, the first, lower beam 5 is connected to the sloping portions 9 and 10, at their lower ends, by screws extending through the respective sloping portion 9, 10 into the end sides of the lower beam 5, and the second, upper beam 6 is connected to the sloping portions 9 and 10 at their upper ends, by screws extending through the respective sloping portion 9, 10 into the end sides of the upper beam 6. Consequently, thanks to the sloping of these portions 9 and 10 the lower beam 5 will be located in front of the upper beam 6 in the moving direction N seen from above along a vertical line. Furthermore, each side portion 3, 4 is connected to a portion 11, 12 extending rearwardly, which each is arranged to support one of the rear wheels 1 at their respective end part. These portions 11, 12 run essentially in parallel to each other and to the moving direction N of the lifting carriage. It is to be noted that these portions 11, 12 may constitute an integrated part of the sidepieces 3, 4 or be mounted on either of the sloping portions 9, 10 or the longitudinal portions 7, 8.

Furthermore, the lifting carriage comprises a carrying member 13 arranged in such a way that it is standing on an upper surface of the lower beam 5 and is supported, in a lateral direction, against a side surface of the upper beam 6. As is evident from FIGS. 1 to 3, the carrying member 13 is shaped as an elongated bar-like element, further named lifting post 13. It is in the example shown manufactured by extruded aluminium.

Furthermore, the lifting carriage comprises a lifting member in form of a lifting plate 14, which is arranged to receive objects to be lifted. It is to be noted that the lifting member may also be constructed in other ways, for example as so-called lifting forks. The lifting plate 14 is fixed to a support member 15 which extends essentially in parallel with the lifting post 13 which on its part is fixed to a slide 16 extending through a longitudinal gap 13A of the lifting post 13 and displaceable in the longitudinal direction of the lifting post 13, whereby the lifting plate 14 may be displaced from the lower end position shown in the figures to an upper end position in the upper end of the lifting post 13. The slide 16 is driven by means of a rotatable screw member 17 provided in the interior of the lifting post 13. The rotation of the screw member 17 is provided by means of an electric driving motor 18 arranged under the lower beam 5. The energy supply to the motor 18 is guaranteed by means of a battery package 19 arranged on the lifting post 13 on the side facing away from the lifting plate 14. Furthermore, the lifting carriage comprises a handle 20 for a simple and comfortable move of the lifting carriage on the base. A releasable control unit 21 is arranged on the handle 20, by which the driving motor 18 may be activated for lifting and lowering of the lifting plate 14, respectively. Furthermore, the lifting carriage comprises brakes (not shown) which are acting at least on the rear wheels 1 and activateable by means of a foot member 22 extending inwardly in a curved bow from the two portions 11, 12 extending rearwardly.

For the displacement of the slide 16, and thereby the lifting plate 14, along the lifting post 13, there is a nut member 23 having internal threads which have a pitch of thread corresponding to the pitch of thread of the screw member 17. The screw member 17, which extends through essentially the whole lifting post 13, also extends through a passage in the slide 16. In the upper end of the lifting post 13, the screw member 17 is mounted by means of a roller bearing 24, and at the lower end of the lifting post 13 the screw member 17 extends through the lower beam 5 and comprises a connection 25 by which the screw member 17 is connectable to an output shaft of a worm gear device, input shaft of which is connected to the driving motor 18, see FIG. 5. In the upper end of the lifting post 13, a limit switch (not shown) also may be positioned, which switches off the current to the driving motor 18, when the slide 16 reaches the upper end position.

The nut member 23 is arranged in an open part of the slide 16 and is connectable to the slide 16 via a coupling device comprising a first coupling member 26 connected to the slide 16 and a second coupling member 27 connected to the nut member 23. In the shown example, the coupling members 26 and 27 each comprise a set of axial teeth which may be arranged to get into engagement with each other. Each tooth comprises a first tooth flank with a surface extending in an essentially axial plane and a second tooth flank with a surface sloping with an angle of inclination in relation to the rotational axis of the screw member 17. Thereby, the sloping surfaces of the tooth flanks of the first coupling member 26 are arranged to interact with the sloping surfaces of the tooth flanks of the second coupling member 27, and the axial surfaces of the tooth flanks of the first coupling member are arranged to interact with the axial surfaces of the tooth flanks of the second coupling member 27. Said angle of inclination is essentially equal to the angle of inclination of the pitch of thread of the screw member 17 and the nut member 23. Furthermore, the angle of inclination of the coupling member 26 and 27 may be the opposite to the angle of inclination of the screw member 17. Furthermore, the nut member 23 is pre-stressed in a direction towards the first coupling member 26 by means of a spring (not shown).

When the screw member 17 is rotated and the nut member 23 is prevented from rotation by the coupling members 26, 27, the nut member 23 and therewith the slide 26 and the lifting plate 14 will be displaced along the screw member 17 and the lifting post 13. In such a way, it is possible to raise and lower the lifting plate 14 and objects located thereon. When the screw member 17 is rotated in the direction raising the lifting plate 14, the force arising between the nut member 23 and the slide 16 will be transferred via the essentially axial surfaces of the tooth flanks. This guarantees a fixed connection between the coupling members 26 and 27 in the lifting direction. When, however, the screw member 13 is rotated in the opposite lowering direction, the force arising between the nut member 23 and the slide 16 will be transferred via the sloping surfaces of the tooth flanks. During normal circumstances when no greater force prevents the lowering displacement of the lifting plate 14, the friction existing between the sloping surfaces of the tooth flanks and the pre-stressing force exerted via said spring will be enough to guarantee the lowering of the lifting plate 14.

However, if the lifting plate 14 runs across any obstruction at its lowering movement the sloping surface of the tooth flank of the first coupling member 26 may slide against the sloping surface of the tooth flank of the second coupling member 27 while compressing of the spring. A continuous sliding movement results gradually in the disengagement of the coupling members 26 and 27 from each other, wherein no displacement force acts any longer on the slide, and the lifting plate becomes standing in the attained position.

The present invention is not restricted to the embodiment shown above but may be varied and modified within the scope of the following claims.

What is claim is:

1. A lifting carriage having a front and a rear, and moveable on a base in a forward direction, said lifting carriage comprising:

a frame having two side pieces rigidly connected to each other by a lower beam and an upper beam, said upper beam spaced above said lower beam;

a set of wheels mounted on said frame and arranged to enable movement of said carriage on said base in said forward direction;

an elongated carrying member provided on said frame and extending upwardly therefrom in a direction away from said base, said carrying member mounted on and supported upright by said lower beam, and joined to and supported laterally by said upper beam; and a lifting member mounted on said carrying member, said lifting member having means for receiving an object to be lifted and displacing said object vertically on said carrying member.

2. A lifting carriage according to claim 1, wherein said upper beam is spaced above and to the rear of said lower beam.

3. A lifting carriage according to claim 2, wherein said two side pieces and said upper and lower beams form a space delimited in three directions and shaped to receive said lifting member.

4. A lifting carriage according to claim 1, wherein said means for displacing said object on said carrying member includes a driving motor mounted under said lower beam.

5. A lifting carriage according to claim 4, wherein said means for displacing said object on said carrying member further includes a screw coupled to and rotated by said driving motor, said screw connected to said lifting member via a nut means for transforming the rotation of said screw to a translational movement of said lifting member.

6. A lifting carriage according to claim 5, wherein said elongated carrying member has a hollow interior and said screw member extends from said hollow interior through said lower beam.

7. A lifting carriage according to claim 6, wherein said elongated carrying member is manufactured from extruded aluminum.

8. A lifting carriage according to claim 1, wherein said side pieces are substantially parallel to each other and extend at least partly beyond said lower beam in said forward direction.

9. A lifting carriage according to claim 1, wherein said lower and upper beams are manufactured from extruded aluminum.

10. A lifting carriage having a front and a rear, and moveable on a horizontal base in a forward direction, said lifting carriage comprising:

a frame having two side pieces rigidly connected to each other by a lower horizontal beam and an upper horizontal beam spaced above and to the rear of said lower horizontal beam;

a set of wheels mounted on said frame and arranged to enable movement of said carriage on said horizontal base in said forward direction;

a lifting post supported upright on said lower beam and joined to and supported laterally by said upper beam; and a lifting member moveably mounted on said lifting post, said lifting member having means for receiving an object to be lifted and displacing said object vertically on said lifting post between a lower position and an upper position.

11. A lifting carriage according to claim 10, wherein said two side pieces, and said upper and lower beams form a space shaped to receive said lifting member when in said lower position.

12. A lifting carriage according to claim 11, wherein said means for displacing said object on said lifting post includes a driving motor mounted under said lower beam.

13. A lifting carriage according to claim 12, wherein said means for displacing said object on said lifting post further includes a screw coupled to and rotated by said driving motor, said screw connected to said lifting member via a nut means for transforming the rotation of said screw to a translational movement of said lifting member.

14. A lifting carriage according to claim 14, wherein said lifting post has a hollow interior and said screw member extends within said hollow interior, through said lower beam and into operative coupling with said driving motor.

15. A lifting carriage according to claim 14, wherein said lifting post, and said lower and upper beams are formed from extruded aluminum.

* * * * *